US005722819A

United States Patent [19]

Broisin et al.

[11] Patent Number: 5,722,819

[45] Date of Patent: Mar. 3, 1998

[54] MOLECULAR DRAG PUMP

[75] Inventors: Jean-Claude Broisin; Olivier Dauvillier; Denis Perrillat-Amede, all of Annecy, France

[73] Assignee: Alcatel Cit, Paris, France

[21] Appl. No.: 671,555

[22] Filed: Jun. 27, 1996

[30] Foreign Application Priority Data

Jun. 30, 1995 [FR] France ..... 95 07922

[51] Int. Cl.[6] ..... F04D 19/04

[52] U.S. Cl. ..... 417/423.4; 415/90

[58] Field of Search ..... 417/423.4, 353; 415/90, 143

[56] References Cited

U.S. PATENT DOCUMENTS

| | | | |
|---|---|---|---|
| 4,808,067 | 2/1989 | Saulgeot | 415/90 |
| 5,501,583 | 3/1996 | Nagaoka et al. | 417/423.4 |
| 5,536,148 | 7/1996 | Nishiuchi et al. | 417/423.4 X |
| 5,664,935 | 9/1997 | Nishiuchi et al. | 415/90 |

FOREIGN PATENT DOCUMENTS

| | | | |
|---|---|---|---|
| 0129709A2 | 1/1985 | European Pat. Off. . | |
| 0603694A1 | 6/1994 | European Pat. Off. . | |
| 2224009 | 10/1974 | France . | |
| 2218615 | 10/1973 | Germany . | |
| 1190990 | 8/1989 | Japan | 417/423.4 |
| 674785A5 | 7/1990 | Switzerland . | |

*Primary Examiner*—Ismael Izaguirre

*Attorney, Agent, or Firm*—Sughrue, Mion, Zinn, Macpeak & Seas, PLLC

[57] ABSTRACT

A molecular drag pump comprising a rotor and a stator, the pump being of the type including at least alternating finned stages of the rotor and of the stator, and in which the rotor is bell-shaped, while the stator includes at least one external portion carrying the stator fins and at least one internal portion penetrating into the bell-shaped rotor, said internal portion closing the pump at its delivery end and including a flange-forming external peripheral rim, wherein said external portion of the stator carrying the stator pins is made up of two half-stators that meet in a diametral plane, each half-stator comprising a single piece and being positioned axially by having a bearing surface situated at its end remote from its suction end that hooks into a complementary circular groove of said internal portion of the stator, and wherein the outside diameter of the first finned stage of the rotor at its suction end corresponds, ignoring operating clearance, to the outside diameter of the external portion of the stator.

3 Claims, 2 Drawing Sheets

MOLECULAR DRAG PUMP

FIELD OF THE INVENTION

The present invention relates to a molecular drag pump.

In particular, the invention relates to a molecular drag pump comprising a rotor and a stator, the pump being of the type including at least alternating finned stages of the rotor and of the stator, and in which the rotor is bell-shaped, while the stator includes at least one external portion carrying the stator fins and at least one internal portion penetrating into the bell-shaped rotor.

BACKGROUND OF THE INVENTION

Usually, this assembly is placed in an external casing defining a suction orifice at one end which includes a fixing flange for connection to an enclosure to be evacuated, and having its other end fixed at said internal portion of the stator against a peripheral rim of said internal portion. The casing also serves to hold the fin-carrying external stator portion in which the fins are constituted by an alternating stack of finned disks and of spacers.

However, a known solution consists in the casing not being secured to said assembly but, on the contrary, belonging to the chamber or enclosure that is to be evacuated. Under such circumstances, the pump assembly without a casing is engaged in the "casing" associated with the vacuum chamber, which casing performs all of the functions of a casing associated with the pump. The advantage is avoiding any gasket at the suction end, where such a gasket is necessary if the pump has its own casing since it is necessary to provide sealing between the pump flange situated at the suction end of the casing and the flange for fixing said pump on the chamber to be evacuated. Unfortunately, if the gasket is made of elastomer, it suffers from the drawback of degassing strongly and therefore of increasing the pressure of residual gases, while if it is constituted by a metal gasket, it suffers from the drawback of requiring a large compression force to ensure sealing and thus of requiring flanges of considerable size.

OBJECTS AND SUMMARY OF THE INVENTION

An object of the present invention is therefore to provide a molecular drag pump of the above-defined type suitable for insertion in a casing belonging to a chamber that is to be evacuated, but on which it is naturally also possible to engage and secure an independent casing, if only for the purpose of connecting it to an enclosure that is to be evacuated, which pump does not include its own "integrated casing", but only a standard connection flange in conventional manner. The invention seeks to provide, in this context, a casing suction diameter that is greater than those presently known, with a first stage of rotor fins that is consequently likewise of greater diameter. Another object is to simplify the casing and assembly thereof.

The invention thus provides a molecular drag pump comprising a rotor and a stator, the pump being of the type including at least alternating finned stages of the rotor and of the stator, and in which the rotor is bell-shaped, while the stator includes at least one external portion carrying the stator fins and at least one internal portion penetrating into the bell-shaped rotor, said internal portion closing the pump at its delivery end and including a flange-forming external peripheral rim, wherein said external portion of the stator carrying the stator pins is made up of two half-stators that meet in a diametral plane, each half-stator comprising a single piece and being positioned axially by having a bearing surface situated at its end remote from its suction end that hooks into a complementary circular groove of said internal portion of the stator, and wherein the outside diameter of the first finned stage of the rotor at its suction end corresponds, ignoring operating clearance, to the outside diameter of the external portion of the stator.

BRIEF DESCRIPTION OF THE DRAWINGS

An embodiment of the invention is described below with reference to the accompanying drawings, in which.

MORE DETAILED DESCRIPTION

Figure 1:
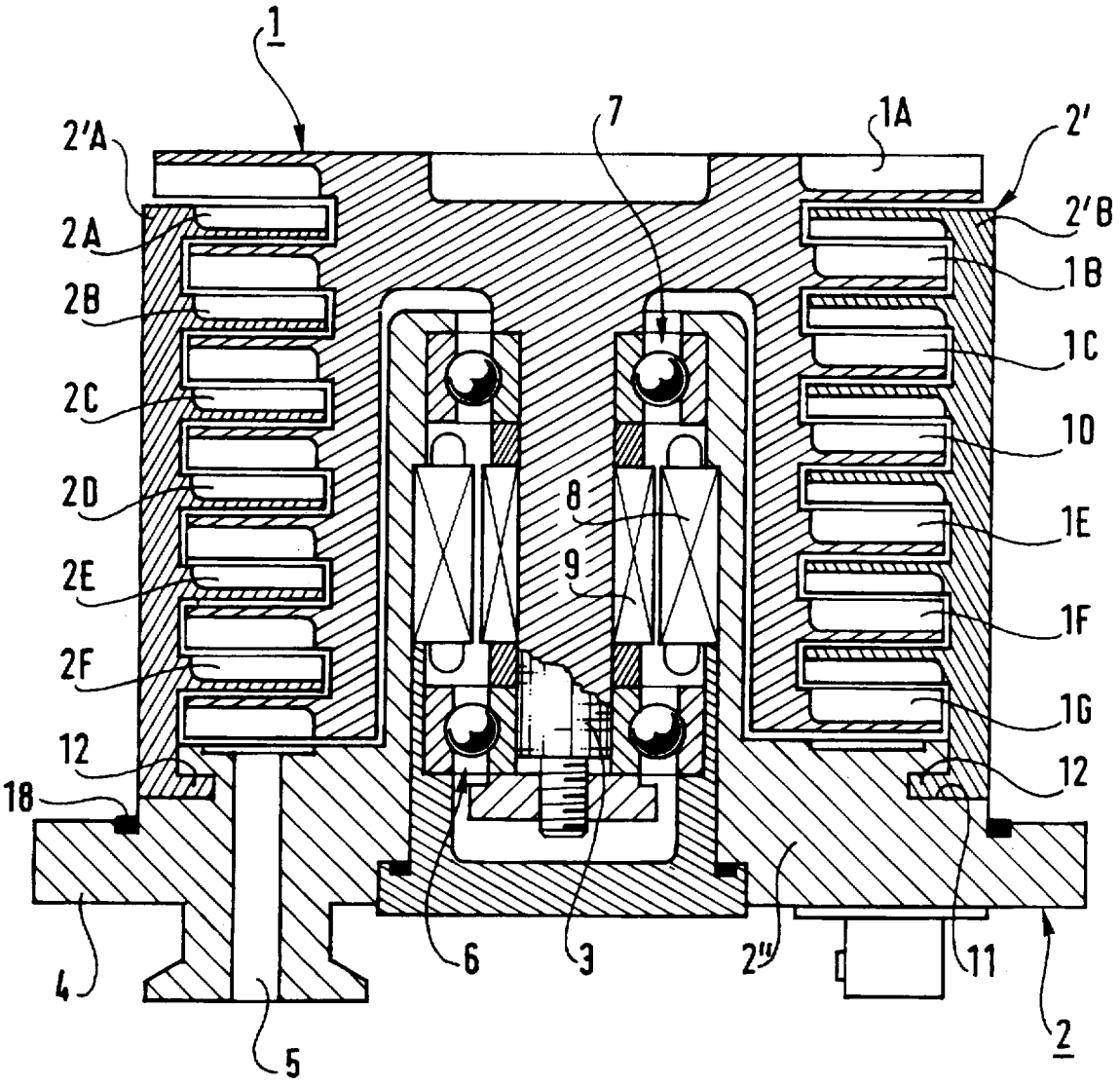
FIG. 1 is an axial section through a molecular drag pump of the invention.

With reference to FIG. 1, there can be seen a molecular drag pump comprising a rotor 1 and a stator 2.

The rotor 1 comprises a plurality of finned stages 1A to 1G, it is in the form of a bell, and it carries a central shaft 3. The stator 2 comprises an external portion 2' and an internal portion 2".

The external portion 2' also includes a plurality of finned stages 2A to 2F, which stages alternate with those of the rotor. The internal portion 2" of the stator penetrates into the rotor and it includes a portion which closes the pump at its delivery end and which includes a flange-forming outer peripheral rim 4. This portion is pierced by a delivery orifice 5. The rotor 1 is supported inside the stator 2 by two bearings 6 and 7 and it is rotated by an electric motor comprising a stator 8 and a rotor 9. The outer portion 2" of the stator is made up of two half-stators 2'A and 2'B (FIGS. 2 and 3) which are separate and which meet in a diametral plane 10. Each half-stator 2'A and 2'B comprises a single piece, with the various finned stages 2A to 2F and the supporting half-cylinder together constituting a single piece, the two half-rotors also being derived from a single cylinder which is cut in two on the diametral plane 10.

The inner portion 2" of the stator 2 has a circular groove 11 which serves to position each half-stator 2'A and 2'B axially. To this end, each half-stator has a bearing surface 12 of section complementary to the groove 11 at its end situated remote from its suction end.

Figure 2:
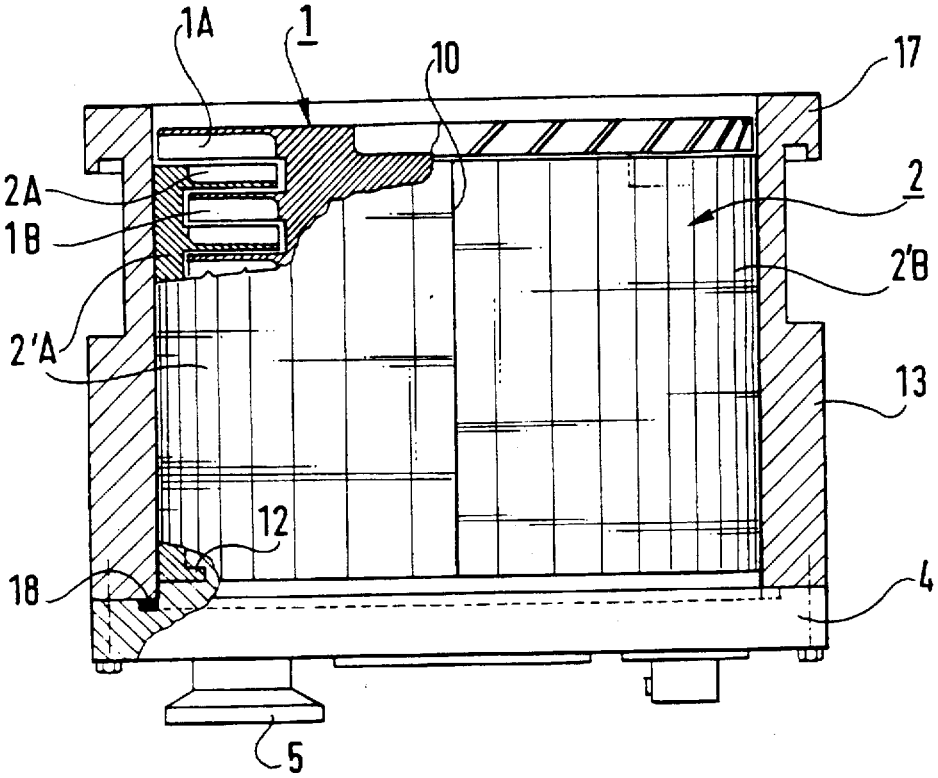
FIG. 2 shows a pump of the invention with its own independent casing.
Figure 3:
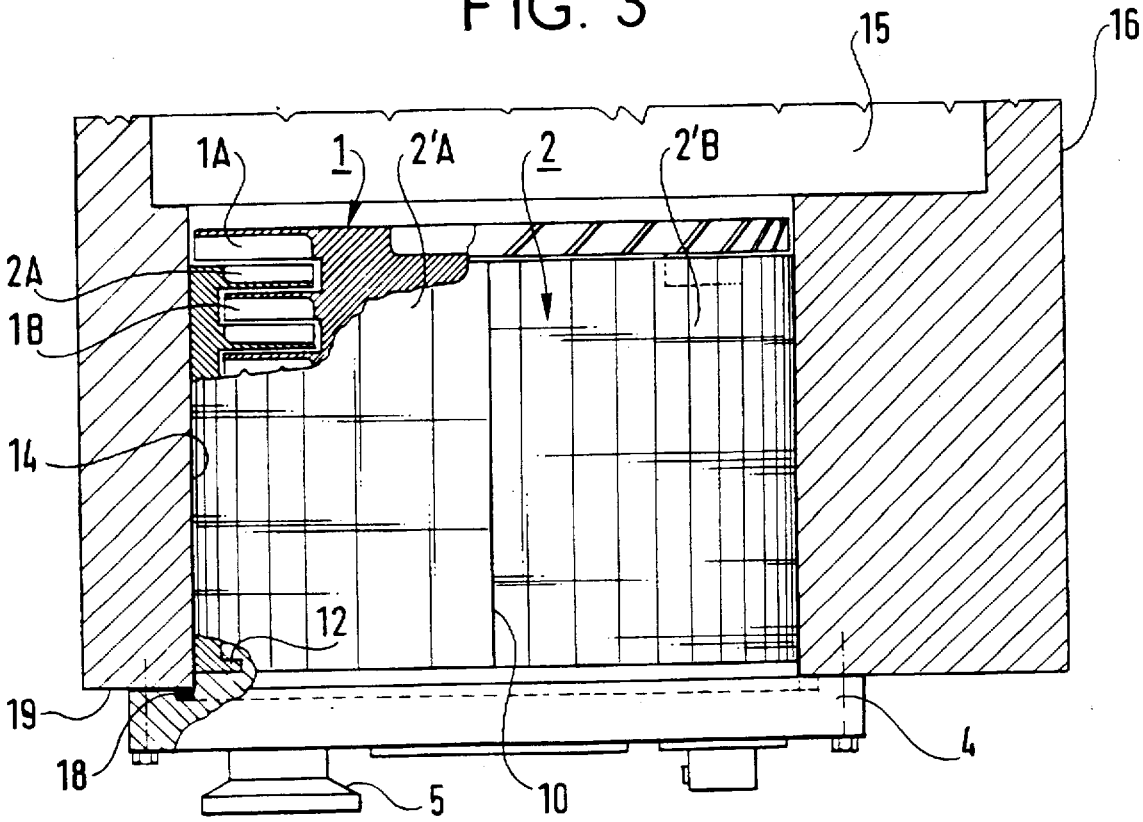
FIG. 3 shows a pump of the invention inserted in a casing belonging to a chamber to be pumped.

The two half-rotors 2'A and 2'B are thus assembled by "hooking" said bearing surface 12 in the groove 11. The entire assembly is held together by being inserted in a matching cylinder that serves as a casing and that may be constituted either by a genuine casing 13 as shown in FIG. 2, or else merely by a cylinder 14 belonging to a chamber 15 of some machine 16, as shown in FIG. 3. In this case, the pump is fixed to the machine 16 by the flange 4 of the pump that is located at its delivery end, which flange comes into engagement against a plane end surface 19 of the cylinder 14, extending perpendicularly to the axis of the pump.

In the example shown in FIG. 2, the casing 13 is also fixed to the flange 4, and at the suction end it includes a flange 17 for connection to an enclosure that is to be evacuated. A gasket 18 is placed between the flange 4 and the casing 13, or the cylinder 14.

Finally, the first finned stage 1A at the suction end of the rotor 1 has an outside diameter which, ignoring operating clearance required to enable the rotor to rotate, corresponds to the outside diameter of the outer portion 2' of the stator, or that of the cylinder 14, or of the flange casing 13 into which the pump is inserted.

Thus, by virtue of the invention, the suction orifice and the diameter of the first rotor stage 1A are substantially identical (ignoring clearance), which diameter is naturally considerably greater than in the prior art since, in the prior art, the casing is used for clamping and assembling the stator made up of an alternating stack of finned disks and of spacers, which means that the suction end of the casing has a shoulder against which the top end of the stator bears, thereby making it necessary for the suction orifice and for the diameter of the first finned stage 1A of the rotor to be smaller. Assembly is also greatly simplified as are the casing 13 or the cylinder 14 since all that is required is a smooth hole of uniform diameter terminating in a plane surface 19 perpendicular to the axis of the pump and for fixing to the flange 4.

We claim:

1. A molecular drag pump comprising a rotor and a stator, the pump being of the type including at least alternating finned stages of the rotor and of the stator, and in which the rotor is bell-shaped, while the stator includes at least one external portion carrying the stator fins and at least one internal portion penetrating into the bell-shaped rotor, said internal portion closing the pump at its delivery end and including a flange-forming external peripheral rim, wherein said external portion of the stator carrying the stator pins is made up of two half-stators that meet in a diametral plane, each half-stator comprising a single piece and being positioned axially by having a bearing surface situated at its end remote from its suction end that hooks into a complementary circular groove of said internal portion of the stator, and wherein the outside diameter of the first finned stage of the rotor at its suction end corresponds, ignoring operating clearance, to the outside diameter of the external portion of the stator.

2. A molecular drag pump according to claim 1, including a casing that is engaged at a close fit over the outside diameter of the external portion of the stator and that fixes to said flange, said casing including a fixing flange at its suction end.

3. A molecular drag pump according to claim 1, wherein it is inserted in a cylinder of single diameter that fits the outside diameter of the outer portion of the stator and that belongs to a chamber of some machine to be evacuated, the outside surface of said cylinder including a plane face perpendicular to the axis of the pump for fixing to the flange.

* * * * *